US005150009A

United States Patent [19]

Kling et al.

[11] Patent Number: 5,150,009

[45] Date of Patent: Sep. 22, 1992

[54] GLOW DISCHARGE LAMP

[75] Inventors: Michael R. Kling, Stratham, N.H.; William J. Roche, Merrimac, Mass.

[73] Assignee: GTE Products Corporation, Danvers, Mass.

[21] Appl. No.: 753,246

[22] Filed: Aug. 30, 1991

[51] Int. Cl.[5] ..... H05B 41/14

[52] U.S. Cl. ..... 315/107; 315/101; 315/105; 315/106; 315/291; 315/307; 315/362

[58] Field of Search ..... 315/107, 205, 362, 291, 315/307, 101, 105, 108

[56] References Cited

U.S. PATENT DOCUMENTS

| | | | |
|---|---|---|---|
| 2,356,369 | 8/1944 | Abernathy | 315/227 |
| 3,567,995 | 3/1971 | Lauritzen | 315/106 X |
| 3,787,751 | 1/1974 | Farrow | 315/137 |
| 4,072,865 | 2/1978 | Craig et al. | 315/106 X |
| 4,172,981 | 10/1979 | Smith | 307/66 |
| 4,288,725 | 9/1981 | Morton | 315/245 |
| 4,438,370 | 3/1984 | Allington | 315/106 |
| 4,500,812 | 2/1985 | Roche | 315/171 |
| 4,945,291 | 7/1990 | Masaki | 315/307 |
| 4,952,844 | 8/1990 | Godyak | 315/205 |
| 5,028,844 | 7/1991 | Sakaguchi et al. | 315/160 |

*Primary Examiner*—Eugene R. LaRoche
*Assistant Examiner*—Son Dinh
*Attorney, Agent, or Firm*—Robert E. Walter

[57] ABSTRACT

An electric circuit for glow discharge lamp which regulates lamp output according to changing environmental conditions includes a power lamp circuit electrically connected between an anode lead-in wire and a cathode to create a lamp voltage, a filament power circuit electrically connected to a pair of cathode lamp filament lead-in wires to create a filament voltage whereby said lamp voltage decreases with an increasing filament voltage due to lamp characteristics, and a sensing and control circuit for adjusting the filament voltage in accordance with changing environmental conditions for maintaining lamp voltage at a predetermined constant value.

8 Claims, 2 Drawing Sheets

GLOW DISCHARGE LAMP

CROSS-REFERENCE TO RELATED APPLICATIONS

This application discloses features which relate to the subject matter of pending application U.S. Ser. No. 07/753,259 of Kling Aug. 30, 1991 and entitled "Glow Discharge Lamp", and assigned to assignee of the present application.

FIELD OF THE INVENTION

The present invention relates to negative glow discharge lamps and electronic ballast circuits for use with such lamps.

BACKGROUND OF THE INVENTION

A negative glow discharge lamp typically comprises a light-transmitting envelope containing a noble gas and mercury with a phosphor coating on an inner surface of the envelope which is adapted to emit visible light upon absorption of ultraviolet radiation that occurs when the lamp is excited. The lamp is excited by means of the application of a voltage between the lamp electrodes. Current flows between the electrodes after a certain potential is applied to the electrodes, commonly referred to as the breakdown voltage. An elementary explanation of the phenomenon is that the gas between the electrodes becomes ionized at a certain voltage, conducts current, and emits ultraviolet radiation. The phosphor coating on the inner surface of the lamp envelope is caused to fluoresce and re-emit a substantial portion of the ultraviolet radiation as visible light. The spectral characteristics of the visible light are determined principally by the composition of the fluorescent powders used for the phosphor coating. During operation, negative glow discharge lamps generally require a series-connected current-limiting device. Without the current being limited, the discharge potential drops and the current increases until the lamp fails due to current overload.

Prior U.S. patents describe the use various of ballast circuits to control the current. The use of capacitive ballasts with or without rectifier circuits are described in U.S. patents 2,356,369 to Abernathy; 4,288,725 to Morton, 4,172,981 to Smith, 4,500,812 to Roche, and 3,787,751 to Farrow. U.S. patent 4,952,844 to Godyak et al describes a ballast using a rectifier bridge intercoupling a capacitor and the electrodes of the lamp.

One major problem common to negative glow lamps is their sensitivity to operating conditions. The lamp voltage is determined primarily by cathode fall which is in turn dependent on mercury vapor pressure, cathode condition, and amount of external cathode heat provided. When mercury vapor pressure is low, as in the case during lamp warm-up, under dimming, and with low ambient temperature, cathode fall increases so that severe sputtering damage and lowered efficacy due to buffer gas excitation may result. When mercury vapor pressure is high due to high ambient temperature or before stabilization, cathode fall and lamp voltage are low reducing lamp wattage and efficacy. The negative glow lamp is also very sensitive to changes in cathode quality which increase or decrease emissivity resulting in the same problems.

Because of the high discharge current and low voltage attendant with a negative glow discharge lamp, the most practical ballast for the lamp is electronic. Under normal operating conditions, the direct current negative glow lamp requires circulatory current to achieve adequate cathode temperature. In the direct current lamp, the cathode receives its power from a combination of ion bombardment, $I^2R$ heating from the discharge current, and from the externally supplied circulatory current. These requirements change when the lamp is dimmed or operated in hot or cold environments. Thus, optimization of the ballast circuit to take into account these variables is difficult.

When overheated, the thermionic emission increases and the cathode fall drops below optimum reducing lamp power and efficacy. At some point the discharge becomes unstable and flicker is objectionable. When underheated, the cathode fall increases causing rapidly increasing sputtering damage and shortened life. Therefore, the negative glow lamp is extremely sensitive to operating conditions which shift the lamp voltage away from the optimum range with resulting short life or poor efficacy.

SUMMARY OF THE INVENTION

Accordingly, it is an object of the present invention to provide an improved electronic ballast circuit for use in powering low voltage, high current discharge lamps.

Accordingly, it is an object of the present invention to provide an improved electronic ballast circuit which provides and optimum voltage during operation of the lamps.

A further object of the present invention is to provide improved electronic ballast circuit for driving a DC discharge lamp.

In accordance with the present invention, there is provided a glow discharge lamp having an electronic circuit for regulating lamp output according to changing environmental conditions comprising:

a light transmitting envelope having a phosphor coating and containing mercury and a noble gas fill;

an anode disposed in said envelope having a single lead-in wire;

a cathode lamp filament located within said envelope having a pair of lead-in wires;

a power lamp circuit electrically connected to between said anode lead-in wire and said cathode for creating a lamp voltage;

a filament power circuit electrically connected to said pair of cathode lamp filament lead-in wires for creating a filament voltage whereby said lamp voltage decreases with an increasing filament voltage;

a sensing and control circuit for adjusting the filament voltage in accordance with changing environmental conditions for maintaining lamp voltage at a predetermined constant value; and said sensing and control circuit including means for detecting lamp voltage in excess of said predetermined value and means responsive to said detecting means for increasing said filament voltage for reducing said lamp voltage to said predetermined value.

BRIEF DESCRIPTION OF THE DRAWINGS

The invention will become more readily apparent from the following exemplary description in connection with the accompanying drawings, wherein.

BEST MODE FOR CARRYING OUT THE INVENTION

For a better understanding of the present invention, together with other and further objects, advantages and capabilities thereof, reference is made to the following disclosure and appended claims in connection with the above-described drawings.

Figure 1:
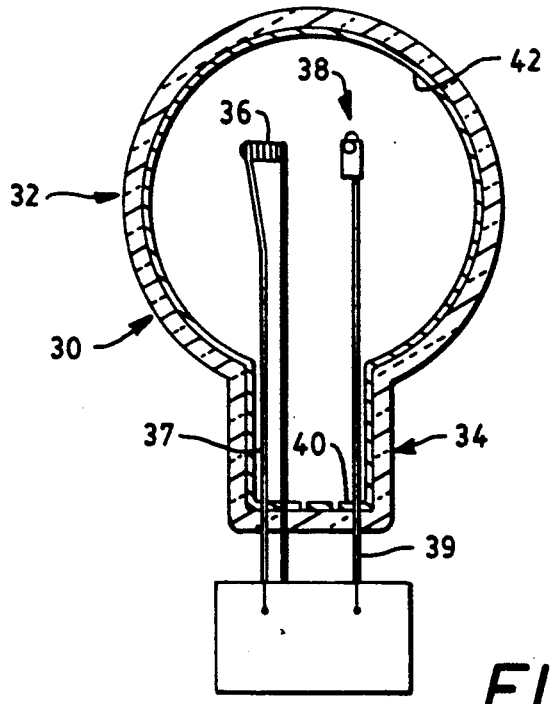
FIG. 1 is a cross-sectional view of a direct current negative glow discharge lamp.

Reference is made to FIG. 1 where a lamp envelope 30 has a bulbous region 32 and a neck region 34. Within the envelope 30 there is disposed a cathode electrode 36 and an anode electrode 38. The envelope contains a fill material that emits ultraviolet radiation upon excitation. The fill material contains mercury and a noble gas or mixture of noble gases. In one embodiment the lamp may be filled with a noble gas mixture at 3 torr. This mixture may be 99.5% neon and 0.5% argon with approximately 30 mg in weight of mercury. The inner surface of the envelope 30 is coated with phosphor coating 42 having spectral characteristics of the visible light determined by the composition of the fluorescent powders used for the phosphor coating.

The cathode electrode 36 may be a standard tungsten exciter coil. Lead-in wires 37 support the cathode electrode 36 and provide current to heat the cathode 36. The cathode electrode 36 is coated with an emissive material such as a barium containing material. A single lead-in wire 39 supports the anode electrode 38. The rod like lead-in wires 37 and 39 are hermetically sealed such as by a wafer stem assembly 40 such as known in the art.

In the glow discharge lamp, lead-in wire 39 is connected to the positive terminal of a d.c. power supply. One of the lead-in wires 37 is connected to the negative terminal of the power supply. Lamp voltage is measured between the circuit ground and the anode electrode 38. Upon ignition, a glow discharge is produced between anode 38 and cathode 36. Various techniques may be utilized to start the lamp. In a preheat start, the cathode is heated with a specified preheat current for about one second before application of lamp power. In a rapid start where a glow to arc transition occurs, circulatory current and lamp power are applied simultaneously. In an instant start, a high open circuit voltage starts the lamp without preheat.

After start-up and during lamp operation, the cathode current is adjusted to maintain a preferred predetermined lamp voltage and varies in accordance with environmental conditions. Due to the glow lamp operating characteristics, lamp voltage decreases with an increasing filament voltage due to increased thermionic emission. If the temperature of the lamp environment decreases, the lamp voltage may undesirably increase so that an appropriate increase in the filament voltage is desirable to increase the filament current and increase the emissivity of the electrode so as to reduce the lamp voltage. On the other hand, if the operating temperature of the lamp increases, the lamp voltage may undesirable decrease below the desired predetermined value. In this case, the lamp voltage may be desirably increased to the appropriate value by decreasing filament voltage which decreases the filament current and the thermionic emission of the cathode. The decreased thermionic emission from the cathode increases the lamp voltage. Preferably the lamp voltage is maintained from about 12 to about 16 volts, more preferably about 14 to 16 volts.

Figure 2:
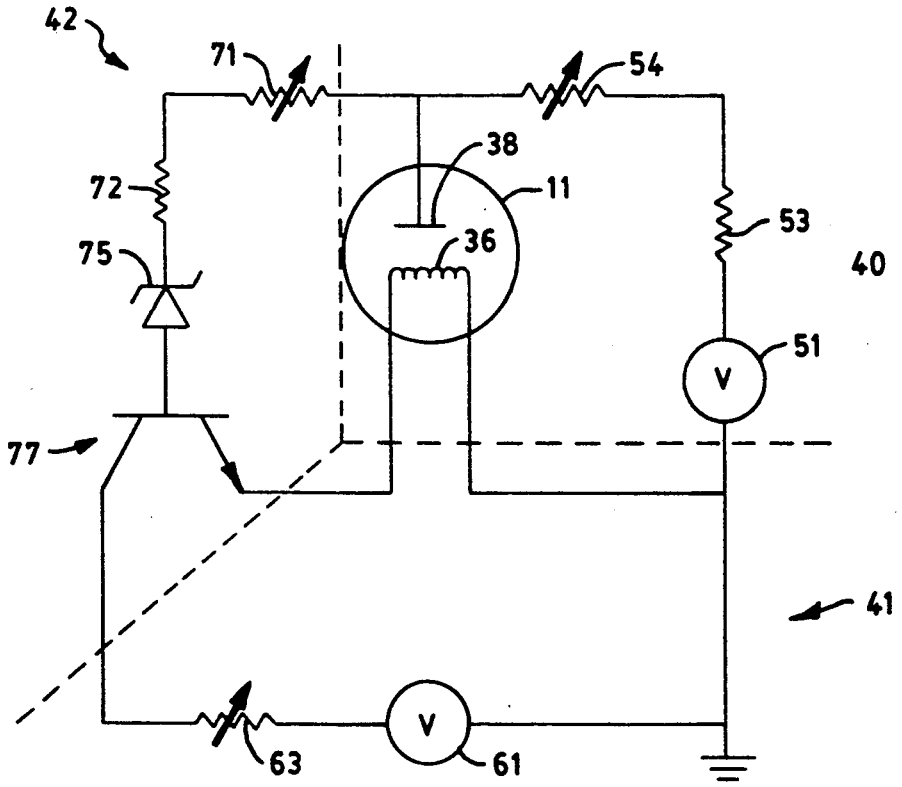
FIG. 2 is a schematic diagram of a circuit for starting and operating a negative glow discharge lamp according to the present invention.

Reference is now made to FIG. 2 which illustrates a schematic diagram of a circuit for starting and operating the negative glow discharge lamp of the present invention. The lamp 11 is a low voltage, high current negative glow discharge lamp having a anode 38 and cathode 36. The lamp voltage is measured between the anode 38 and circuit ground. In accordance with the principles of the present invention, it is desirable to maintain the lamp voltage during operation of the lamp at a relatively constant voltage, preferably from about 13 to about 15 volts. The circuits utilized in the present invention control the filament voltage or the voltage across the cathode 36 in a precise manner. A power lamp circuit 40 is utilized to supply electrical current between the anode and cathode. A filament power circuit 41 supplies electrical current through the filament in accordance with a filament voltage, and a sensing and control circuit 42 senses changes in the lamp voltage and adjusts the filament voltage to maintain the the lamp voltage at a relative constant voltage.

As illustrated in FIG. 2, the power lamp circuit 40 includes the 50 volt 3 ampere power source 51, a 5 ohm resistor 53, and a variable resistor 54 connected in series with the lamp anode 38 and lamp cathode 36 so as to supply an appropriate lamp current. The filament power circuit 41 includes the 25 volt, 5 ampere power source 61, a control transistor 77, and the variable resistor 63 connected in series with the lamp filament 36. The sensing and control circuit 42 is operably connected to the lamp power circuit 40 and the filament power circuit 41 for sensing lamp voltage and controlling the filament voltage in accordance with the sensed voltage.

The sensing and control circuit 42 includes a pair of resistors 71 and 72 connected in series to limit the base current to the control transistor 77 and zener diode 75. The zener diode 75 only permits the flow of current provided the voltage exceeds a predetermined value, i.e. 11.4 volts for the device shown in the drawing. Hence, for voltage levels under a predetermined value, the sensing and control circuit 42 is inoperative.

Once the voltage as determined by the zener diode 75 is exceeded, current flows in the sensing and control circuit 42 causing the transistor 77 to establish the current flow in the filament power circuit 41 and hence maintain a constant lamp voltage. The transistor 77 acts as a voltage sensitive switch. Current regulation in the filament power circuit 41 is in accordance with the formula $$dI_c/dV_1]_{V_Z=11.4v}=B/R_3+R_4 \qquad \text{Eq (1)}$$

where $\beta$ is the transistor amplification factor.

Accordingly, the circuit was operated with the following settings: filament power voltage 61 at 15 volts, lamp power voltage at 51 volts, resistor 54 at 5 ohms, resistor 53 at 50 ohms, resistor 71 at 50 ohms, and resistor 73 at 27 ohms. The zener diode 75 and transistor 77 values are as previously set forth. The nominal lamp values were $V_1=$ 14 volts, $I_1=$ 2 amps, $V_c=$ 3 volts, $I_c=$ 1.3 amps. Note that $dI_c/dV_1$ can be increased by selecting a value for $V_Z$ closer to $V_1$ and adjusting $R_3$ accordingly.

Figure 3:
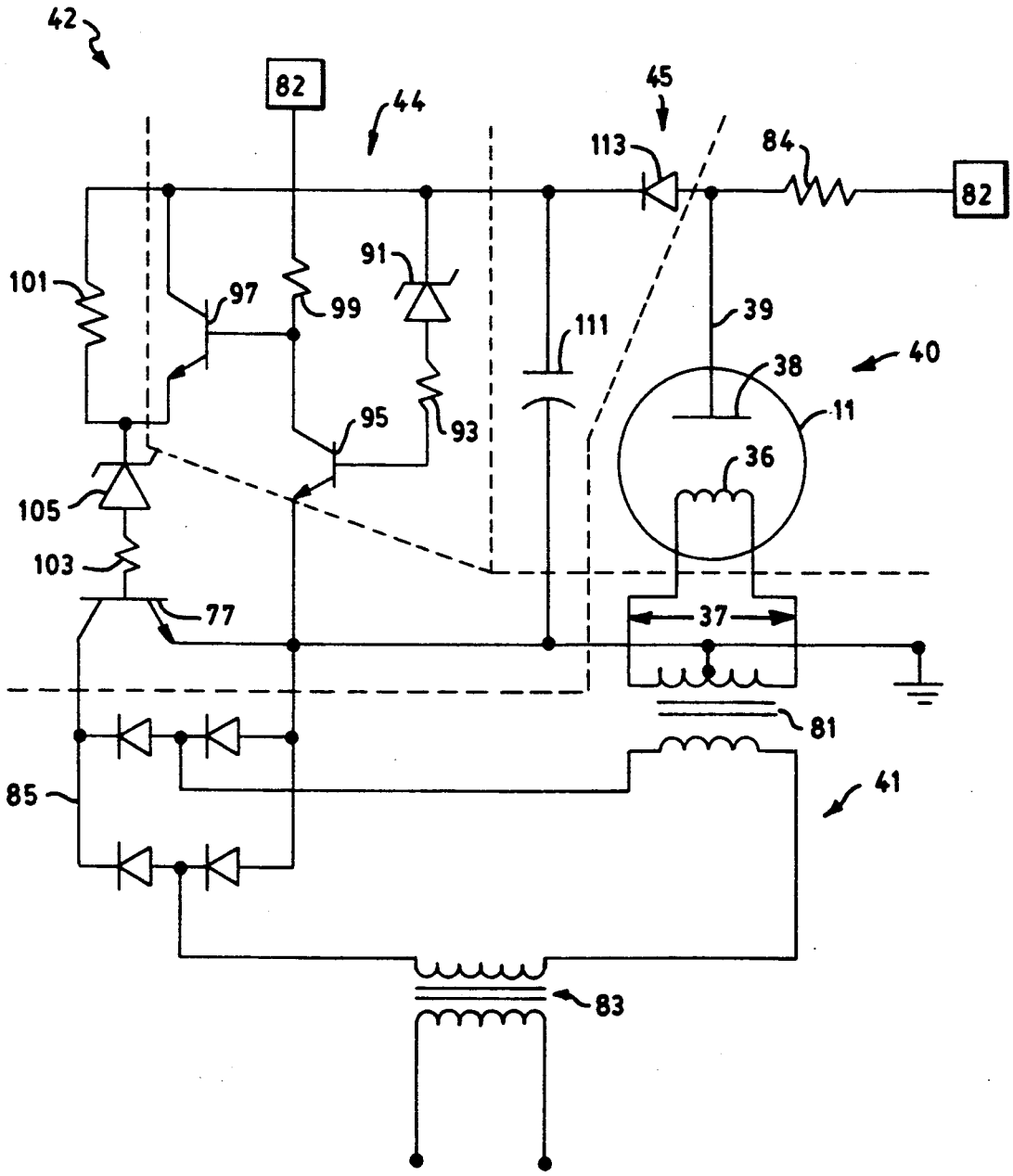
FIG. 3 is another schematic diagram of a circuit for starting and operating a negative glow discharge lamp according to the present invention.

FIG. 3 illustrates another circuit in accordance with the present invention, which, when compared to the circuit described in FIG. 2 includes preferred embodiments of the present invention. The filament power circuit 41 is A.C. as opposed to the D.C. current of power lamp circuit of FIG. 2. A transformer 81 utilizes a center tap so as to obtain a more uniform current on the filament coil. The sensing and control circuit 42 includes a start up circuit 44 which increases the resistance in the zener diode circuit during start up so as to prevent damage due to high voltage and current that occurs during lamp start up. Additionally, the sensing and control circuit 42 includes a filter and sensing circuit 45 in the form of a capacitance loop which filters out the ripple in the rectified lamp A.C. voltage so that peak voltage in the lamp wave form is sensed.

With respect to FIG. 3, in more detail, the power lamp circuit 40 includes a 35 volt D.C. power supply 82. A resistor 84 is connected in series with the lamp. The filament power circuit 41 includes a transformer 83 which reduces the A.C. 120 volt power supply to 12.6 volt A.C.. A rectifier bridge 85 converts the A.C. to full wave rectified D.C. The cathode 36 is connected to the center tap transformer 81 as hereinbefore described. The center-tapped coil of the transformer 81 associated with the power lamp circuit 40 is connected to ground and to one terminal of the the rectifier bridge 85. The coil of the transformer 81 associated with the filament circuit 41 is connected to one side of the 12.6 volt transformer winding and another terminal of the rectifier bridge 85 so as to provide a source of AC power to the bridge rectifier.

The start-up circuit 44 includes a zener diode 91 which permits current to flow when a predetermined voltage such as 18 volts is exceeded. The resistor 93 is connected in series with the base of transistor 95 which, together with transistor 97 and resistor 99, controls the current flow through zener diode 105 at the higher voltage levels associated with lamp start-up. During start-up switching, transistor 97 diverts current through resistor 101 which provides a high resistance path. After an initial lamp start up, when the lamp voltage reduces to less than the predetermined value, transistor 95 cuts off and transistor 97 turns on. This shunts resistor 101 so as to provide a low resistance circuit to operate transistor 77 for maximum dynamic gain as shown by Eq. 1.

After start up, the function of the filament power circuit 41 is to control the filament voltage and hence the lamp voltage in accordance with changing conditions during lamp operation so that the lamp voltage remains relatively constant. This is performed by the resistors 101, 103 and zener diode 105 which operate in the manner described with respect to the resistors 71, 72, and zener diode 75 illustrated in FIG. 2.

So as to precisely control the voltage, the sensing and control circuit 42 preferably includes filter capacitor 111 and diode 113. Because the lamp voltage is preferably maintained between 14 and 15 volts, any ripple in the lamp voltage must be eliminated before the lamp voltage is applied to the closed-loop sensing and control circuit 42. The filament voltage produces a modulation of the lamp voltage so as to actually reduce the lamp voltage as measured at the lamp terminals. This has the effect of confusing the sensing and control circuit 42 into sensing that the lamp voltage is too low and respond by decreasing the filament voltage. The decrease in filament voltage causes a corresponding increase in the lamp voltage which may be above the desired constant value. The capacitor filter 111 levels out the wave form resulting in more precise voltage control. The diode 113 is connected between the capacitor 111 and the anode 38. The diode 113 and capacitor 111 arrangement result in a leveling out of the wave form and filtering out the ripple in the lamp voltage so that peak voltage in the wave form is sensed.

While there have been shown and described what are at present considered to be the preferred embodiments of the invention, it will be apparent to those skilled in the art that various changes and modifications can be made herein without departing from the scope of the invention. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A glow discharge lamp having an electronic circuit for regulating lamp output according to changing environmental conditions comprising:

a light transmitting envelope containing mercury and a noble gas fill;

an anode disposed in said envelope having a single lead-in wire;

a cathode lamp filament located within said envelope having a pair of lead-in wires;

a power lamp circuit electrically connected between said anode lead-in wire and said cathode for creating a lamp voltage;

a filament power circuit electrically connected to said pair of cathode lamp filament lead-in wires for creating a filament voltage whereby said lamp voltage decreases with an increasing filament voltage;

a sensing and control circuit including a lamp start up circuit for limiting control circuit current and voltage during startup, said sensing and control circuit being adapted for adjusting the filament voltage in accordance with changing environmental conditions for maintaining lamp voltage at a predetermined constant value from about 11 to about 16 volts; and said sensing and control circuit including means for detecting lamp voltage in excess of said predetermined value and means responsive to said detecting means for increasing said filament voltage for reducing said lamp voltage to said predetermined value.

2. A glow discharge lamp having an electronic circuit for regulating lamp output according to changing environmental conditions according to claim 2 wherein said sensing and control circuit include a zener diode for sensing when said voltage exceeds a desired predetermined value.

3. A glow discharge lamp having an electronic circuit for regulating lamp output according changing environmental conditions according to claim 2 wherein said sensing and control circuit include a switching transistor for sensing when said voltage exceeds a desired predetermined value and reducing filament voltage.

4. A glow discharge lamp having an electronic circuit for regulating lamp output according to changing environmental conditions according to claim 1 wherein said power lamp circuit is a source of direct current.

5. A glow discharge lamp having an electronic circuit for regulating lamp output according to changing environmental conditions according to claim 4 wherein said filament power circuit is a source of alternating current.

6. A glow discharge lamp having an electronic circuit for regulating lamp output according to changing environmental conditions according to claim 4 wherein said filament power circuit is a source of direct current.

7. A glow discharge lamp having an electronic circuit for regulating lamp output according to changing environmental conditions according to claim 5 wherein said filament power circuit is a source of direct current rectified from alternating current.

8. A glow discharge lamp having an electronic circuit for regulating lamp output according, to changing environmental conditions according to claim 7 wherein said sensing and control circuit include a filter circuit for leveling out a rectified direct current wave form.

* * * * *